US006450540B1

(12) United States Patent
Kim

(10) Patent No.: US 6,450,540 B1
(45) Date of Patent: Sep. 17, 2002

(54) PRINTED MATTER DISPLAYING VARIOUS COLORS ACCORDING TO VIEW ANGLE

(75) Inventor: Chung Hwan Kim, Seoul (KR)

(73) Assignee: Technology Tree Co., LTD, Seoul (KR)

( * ) Notice: Subject to any disclaimer, the term of this patent is extended or adjusted under 35 U.S.C. 154(b) by 0 days.

(21) Appl. No.: 09/714,039

(22) Filed: Nov. 15, 2000

(51) Int. Cl.[7] ..... B42D 15/00

(52) U.S. Cl. ..... 283/91; 40/124.01; 283/81; 283/114; 428/29; 428/42.1

(58) Field of Search ..... 40/124.01; 283/81, 283/91, 94, 93, 107–111, 114; 428/29, 41.6, 42.1, 46

(56) References Cited

U.S. PATENT DOCUMENTS 4,033,059 A * 7/1977 Hutton et al. ..... 40/137
4,708,920 A * 11/1987 Orensteen et al. ..... 283/85
4,932,685 A * 6/1990 Mancuso ..... 283/91
4,968,064 A * 11/1990 Mancuso ..... 283/91
5,074,597 A * 12/1991 Mancuso et al. ..... 283/91
5,298,922 A * 3/1994 Merkle et al. ..... 283/85
6,113,149 A * 9/2000 Dukatz ..... 283/91
6,170,881 B1 * 1/2001 Salmon et al. ..... 283/91
6,176,521 B1 * 1/2001 Mancuso ..... 283/91

* cited by examiner

*Primary Examiner*—A. L. Wellington
*Assistant Examiner*—Monica S. Carter
(74) *Attorney, Agent, or Firm*—Perkins Coie LLP

(57) ABSTRACT

A printed matter such as an advertisement material is provided. The printed matter includes a printing layer provided on a base plate and having various colors printed thereon such that half-tone dots of the respective colors are printed and overlap at a predetermined portion. A projection layer made of transparent epoxy resin or ultraviolet resin for covering only a particular portion of the printing layer intended to be emphasized, is formed on the printing layer. Also, a plurality of hemispherical protrusions made of transparent ultraviolet resin is formed on the projection layer using a screen printing method. The respective colors of the printing layer disposed beneath the hemispherical protrusions are refracted at different refraction angles to then be visually perceived. Thus, the colors, which are not visually perceived by naked eye, are made visible, thereby providing a three-dimensional effect to the printing layer.

1 Claim, 2 Drawing Sheets

PRINTED MATTER DISPLAYING VARIOUS COLORS ACCORDING TO VIEW ANGLE

BACKGROUND OF THE INVENTION

1. Field of the Invention

The present invention relates to a printed matter such as advertisement materials or commodity catalogs, and more particularly, to a printed matter which can provide a three-dimensional effect to a printing layer by varying colors of the printing layer according to a view angle.

2. Description of the Related Art

There are many known techniques for providing a three-dimensional effect to a printing layer such that the colors printed on a plane of the printing layer are varied according to a view angle. For example, Korean Utility Model Publication No. 1998-68600, which was filed by the applicant of the present invention, discloses that a printing layer is constructed such that half-tone dots of three primary colors, i.e., red, yellow and blue, and black, are printed on one-side plane of a base plate at predetermined printing angles, the half-tone dots overlapping with each other at a predetermined portion, and a plurality of hemispherical protrusions made of transparent resin are formed on the other-side plane of the base plate such that the center of each of the protrusions is disposed at a portion where the half-tone dots of the respective colors overlap with each other.

However, in the printed matter described in the above-stated Korean Utility Model Publication, the hemispherical protrusions and the printing layer are opposite to and face each other at either side of the base plate. Thus, in order to form the hemispherical protrusions, after forming the printing layer on one-side plane, the base plate must be reversed. Thus, the fabrication process cannot be carried out continuously, resulting in lowering in fabrication efficiency. Also, it is not possible to partially provide a three-dimensional effect to the printing layer. Further, since the base plate is made of a transparent material, light is transmitted through the printing layer formed on the other side thereof, so that the printing layer cannot be displayed in its original color but is displayed in a faded color due to light. As a result, the color projected on the protrusions is not visually clear. To prevent light from being transmitted through the printing layer, a separate printing layer must be formed on the other side of the printing layer, which is quite a complicated work, thereby undesirably increasing the fabrication cost.

SUMMARY OF THE INVENTION

To solve the above problems, it is an object of the present invention to provide a printed matter displaying various colors according to a view angle, by which a three-dimensional effect can be provided to a printed pattern by making invisible colors visible according to a view angle, the fabrication efficiency can enhanced by continuously performing the fabrication process, and the fabrication cost can be reduced by reducing the quantity of raw materials required for forming a projection layer.

To accomplish the above object, there is provided printed matter displaying various colors according to a view angle, including an opaque base plate, a printing layer provided on the base plate and having various colors printed thereon such that half-tone dots of the respective colors are printed at different angles and overlap at a predetermined portion, a projection layer made of transparent resin, and partially formed to a predetermined thickness at only a particular portion intended to display a special color on the printing layer using a screen printing method, and a plurality of hemispherical protrusions made of transparent resin using a screen printing method such that the centers thereof are positioned at predetermined portions where the half-tone dots of the respective colors of the printing layer overlap with each other.

The aforementioned printed matter is constructed such that the hemispherical protrusions serving as a magnifying lens are spaced an appropriate distance apart from the printing layer by means of the projection layer to allow the colors of the printing layer to be refracted and enlarged. Thus, the overlapping colors, which are not visually perceived by naked eye, are made visible, thereby attaining a three-dimensional effect of a printed pattern. Also, since the printing layer, the projection layer and protrusions are sequentially stacked on the base plate, the fabrication process can be continuously performed, thereby enhancing the fabrication efficiency. Further, since the projection layer is partially formed on the printing layer, the fabrication cost can be reduced by reducing the quantity of raw materials required for forming the projection layer.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

A printed matter according to the present invention will now be described with reference to the accompanying drawings.

Referring to FIGS. 1A through 3, the printed matter according to the present invention includes a base plate 1 made of paper or synthetic resin. A printing layer 2 having three primary colors, i.e., red, blue and yellow, and black, printed thereon, is provided on the base plate 1. FIG. 1B is a partailly enlarged plan view 5 of a printed matter according to the present invention.

Figure 1A:
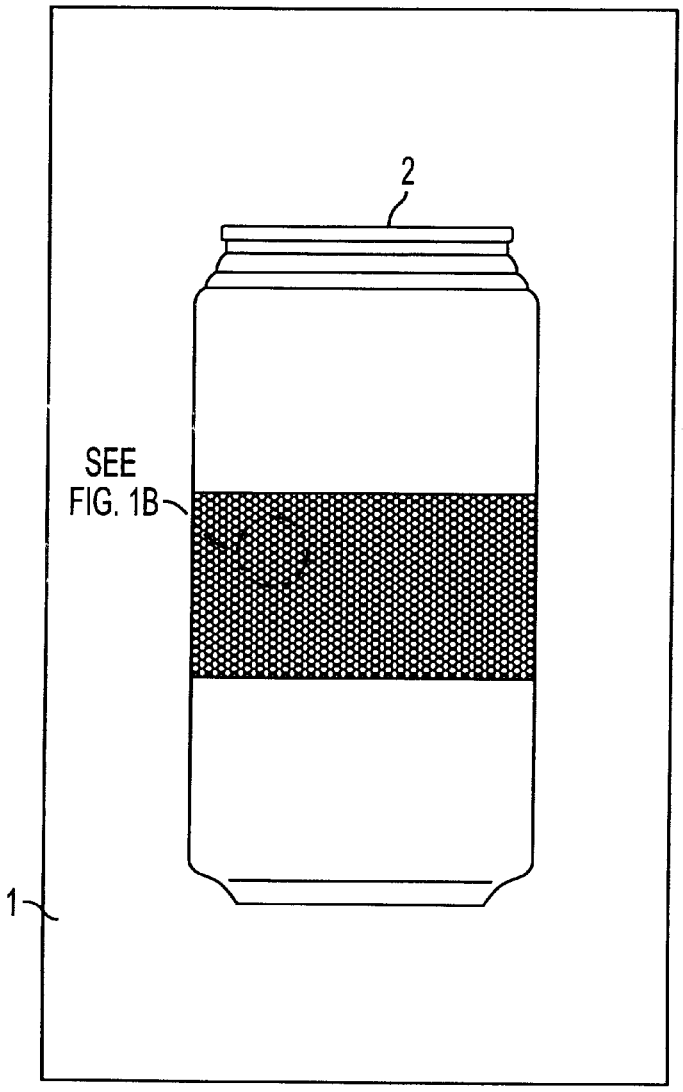
FIG. 1A is a plan view of a printed matter according to the present invention.
Figure 1B:
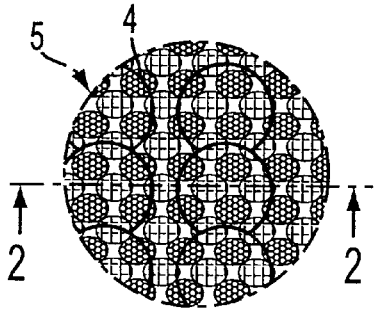
FIG. 1B is a partially enlarged plan view of a printed matter according to the present invention.
Figure 2:
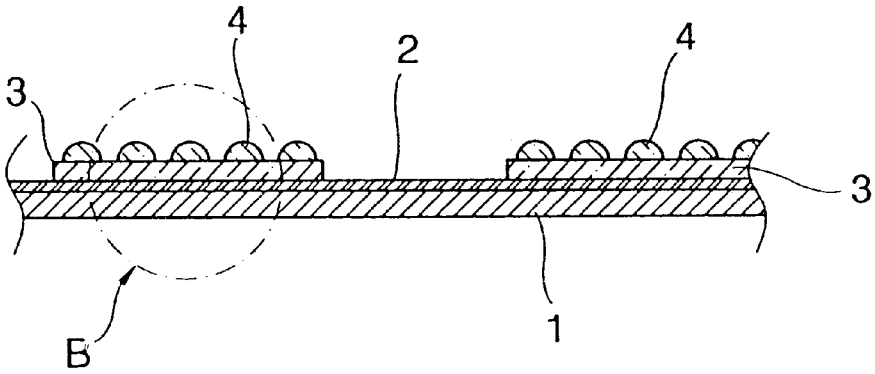
FIG. 2 is a fragmentary view in section on an enlarged scale illustrating the structure of a printed matter according to the present invention, taken on the line 2—2 in FIG. 1B.
Figure 3:
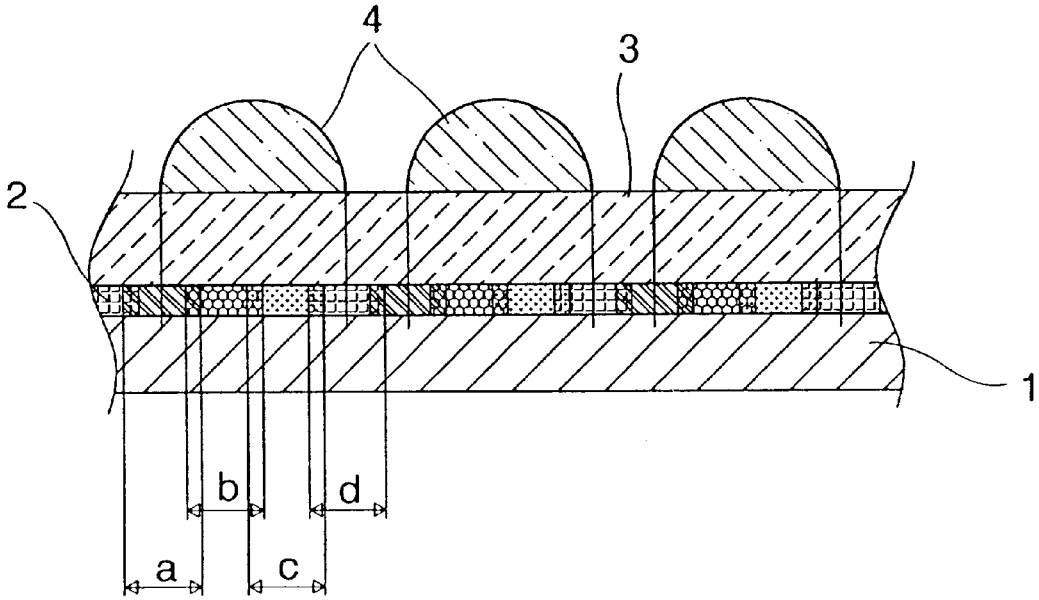
FIG. 3 is a sectional view on an enlarged scale of a portion "B" in FIG. 2.

The respective colors of the printing layer 2 are typically formed such that fine half-tone dots a, b, c and d are printed in a predetermined pattern, as shown in FIG. 3. The respective half-tone dots have different printing angles. Among the half-tone dots of the three primary colors, a, b and c, and the half-tone dot of black, d, the half-tone dots of at least two colors overlap with each other at a predetermined portion to then mix the colors, so that half-tone colors are represented. For example, the printing layer displayed to be violet is due to the overlapping of invisible red and blue half-tone dots a and b.

A projection layer 3 made of transparent resin is partially formed on a particular portion of the printing layer 2 intended to display a special color. The projection layer 3 is preferably made of transparent epoxy resin or ultraviolet resin which is capable of preventing the printing layer 2 from being deteriorated in color quality. Also, the projection layer 3 is formed using a screen printing method. According to the screen printing method, the projection layer 3 can be formed in conformity of an arbitrary shape of the printing layer 2 to be emphasized, and the thickness of the projection layer 3 can be made uniform.

A plurality of transparent protrusions 4 are formed on the projection layer 3 using a screen printing method. The protrusions 4 are preferably formed of transparent epoxy resin or ultraviolet resin to be suitably curved to enlarge an object, like a convex lens. Also, each of the protrusions 4 is preferably formed such that the center thereof is positioned at a portion where the half-tone dots of the respective colors of the printing layer 2 overlap each other.

Here, the thickness of the projection layer 3 formed on the printing layer 2 is closely related with the size of each of the protrusions 4 formed on the projection layer 3. In other words, if the projection layer 3 is thin and the protrusions 4 are large, the protrusions 4 cannot sufficiently enlarge the half-tone dots of the respective colors of the printing layer 2. Conversely, if the projection layer 3 is thick and the protrusions 4 are small, the focal points of the half-tone dots to be enlarged do not coincide with each other. In other words, the thickness of the projection layer 3 is determined by the sizes of the protrusions 4 such that the refractive force by the protrusions 4 is the maximum when the printing layer 2 is viewed from the protrusions 4, and thus the overlapping half-tone dots can be displayed to be large and clean.

The protrusions 4 refract the respective colors of portions where various colors forming the printing layer 2 overlap with each other, thereby displaying various colors according to a view angle. Therefore, the printing layer 2 covered by the protrusions 4 are displayed in a three-dimensional manner.

According to the printed matter of the present invention, since a printing layer, a projection layer and hemispherical protrusions are sequentially formed on one-side plane of a base plate, mass production can be achieved by a continuous fabrication process, thereby increasing the fabrication efficiency. Also, since the projection layer is formed only on a to-be-specially-emphasized portion of the printing layer printed on the base plate, the material required for forming the projection layer can be reduced, thereby attaining cost-efficiency.

What is claimed is:

1. A printed matter displaying various colors according to a view angle, comprising:

a base plate;

a printing layer overlaid on the base plate and having various colors printed thereon in a predetermined pattern, such that each half-tone dot of three primary colors is partially overlap with each other to represent half-tone colors;

a projection layer made of transparent resins and partially formed to a predetermined thickness on the printing layer using a screen printing method; and a plurality of hemispherical protrusions made of transparent resins and formed using a screen printing method, each center of the hemispherical protrusions being positioned at a portion where the half-tone dots are overlap with each other, on the projection layer.

* * * * *